US005516411A

United States Patent [19]

Kotowski et al.

[11] Patent Number: 5,516,411

[45] Date of Patent: May 14, 1996

[54] METHOD AND APPARATUS FOR CONTINUOUS ELECTROLYTIC RECOVERY OF METAL IN RIBBON FORM FROM A METAL CONTAINING SOLUTION

[75] Inventors: Stephan Kotowski, Seligenstadt; Harri Heinke, Erlensee; Wolfgang Blatt, Wächtersbach; Max Mayr, Alzenau; Reinhard Bedel, Mühlheim-Lämmerspiel, all of Germany

[73] Assignee: Heraeus Elektrochemie GmbH, Hanau, Germany

[21] Appl. No.: 374,999

[22] Filed: Jan. 18, 1995

Related U.S. Application Data

[62] Division of Ser. No. 632,039, Dec. 21, 1990, abandoned.

[30] Foreign Application Priority Data

Dec. 23, 1989 [DE] Germany ..... 39 42 876.1
Nov. 26, 1990 [EP] European Pat. Off. ..... 90122495

[51] Int. Cl.[6] ..... C25D 17/00

[52] U.S. Cl. ..... 204/208; 204/216

[58] Field of Search ..... 204/216, 208

[56] References Cited

U.S. PATENT DOCUMENTS 2,844,529 7/1958 Cybriwsky .
2,865,830 12/1958 Zoldas ..... 204/208
3,901,785 8/1975 Buzhinskaya et al. ..... 204/208
4,279,711 7/1981 Vining ..... 204/105 R
4,647,345 3/1987 Polan .
4,786,384 11/1988 Gerhardt et al. .

FOREIGN PATENT DOCUMENTS 0248118 12/1987 European Pat. Off. .
2024112 5/1970 Germany .
619550 8/1978 U.S.S.R. .

OTHER PUBLICATIONS

Derwent Patent Abstracts, JA–7338294–R Furukawa Electric Co. Ltd. "Metal Foil Prodn".
Chemical Abstracts, vol. 103, 1985, Abstract No. 78322 w.

*Primary Examiner*—John Niebling
*Assistant Examiner*—Brendan Mee
*Attorney, Agent, or Firm*—Frishauf, Holtz, Goodman, Langer & Chick

[57] ABSTRACT

To permit continuous roll-off or stripping of metal in form of a ribbon, tape or foil from a rotating cathode roller or drum (3, 43) within a metal ion containing solution, the cathode roller or drum is cooled during operation and the solution of the processing liquid contains a halogen compound or a sulfur compound, for example zinc chloride, to obtain zinc in form of a ribbon, tape or foil. The cathode roller or drum is at least partly, and for example entirely submerged in the ion containing processing solution, rotatable about a horizontal or vertical axis, and the anodes (4, 44) are separated from the ion containing solution by a separating diaphragm or ion exchange membrane.

14 Claims, 5 Drawing Sheets

METHOD AND APPARATUS FOR CONTINUOUS ELECTROLYTIC RECOVERY OF METAL IN RIBBON FORM FROM A METAL CONTAINING SOLUTION

This application is a division of application Ser. No. 07/632,039, filed Dec. 21, 1990, now abandoned.

Reference to related patents, the disclosures of which are hereby incorporated by reference:

U.S. Pat. No. 4,647,345, Polan

U.S. Pat. No. 2,865,830

U.S. Pat. No. 4,786,384, Gerhardt et al, assigned to the assignee of the present application.

Reference to related application, assigned to the assignee of the present applications, the disclosures of which are hereby incorporated by reference:

U.S. Ser. No. 07/458,727, filed Feb. 2, 1990, Kotowski et al.

U.S. Ser. No. 07/616,367, filed Nov. 21, 1990, Kotowski et al, (claiming priority of German Appln. P 39 40 044.1, attorney docket 900868/MO, entitled "ELECTRODE ARRANGEMENT FOR ELECTROLYTIC PROCESSES").

FIELD OF THE INVENTION

The present invention relates to a method and apparatus for continuous recovery of electro-formed metal foil, strip, tape or ribbon from a solution containing metal ions, and more particularly to a method and system which is compact, simple, and requires little maintenance.

BACKGROUND

The referenced U.S. Pat. No. 4,786,384, Gerhardt et al, assigned to the assignee of the present application, and the disclosure of which is hereby incorporated by reference, describes an electrolytic cell for recovery of metal from metal ions contained within a processing liquid, such as an electrolyte, in which a plurality of planar parallel spaced electrodes are located in a trough. The cathodes have openings and, in dependence of the distance to the anode, connecting resistors of different connection resistance connect the cathodes to a current source, so that the current density applied to the respective cathodes will, essentially, be the same at all times.

To remove metal from the cathodes, it is necessary to remove the cathode elements, singly. This is comparatively time and labor consuming; the deposited metal also requires removal from the cathode which further consumes time and effort.

The referenced U.S. Pat. No. 2,865,830 describes an electrolytic arrangement to continuously make a ribbon, strip, foil or tape of copper from a solution containing copper ions, retained in a tank. The copper is deposited on the lower surface of a cathode roller which is rotatable about a horizontal axis. The entire arrangement requires substantial volume, since less than half of the circumferential surface of the cathode roller can be used for deposition of metal. The cathode current, due to the necessarily limited cathode current density, is likewise limited, based on the relatively small circumferential surface which dips into the solution.

The referenced U.S. Pat. No. 4,647,345, Polan, describes an electrolytic system for continuous manufacture of metal foils or strips from a solution retained in a tank, in which the metal is removed from a drum, or an endless belt, dipped in the solution. The region of the drum or belt in the solution is surrounded by an anode, formed with openings or ducts to permit electrolyte to pass. The metal deposited on the cathode is removed after leaving the solution. The cathode has a polished surface, for example of titanium or tantalum. The anode may be a lead-antimony alloy, and the solution is an acidic metal ion solution, for example copper sulfate and sulfuric acid.

The continuous removal of metal from the solution has been found to present problems, and chemically optimizing the process is difficult, if not impossible to achieve.

THE INVENTION

It is an object to provide a method, and an apparatus to carry out the method, in which metal ions can be continuously precipitated or deposited on a cathode and removed therefrom in form of a continuous ribbon, strip, belt or foil; the solution may be a processing solution containing metal ions. The apparatus should be compact and easy to maintain.

Briefly, in accordance with a feature of the invention, the solution which is used contains a halogen or a sulfur compound and, during deposition of metal, the cathode roller is continuously cooled. In accordance with a preferred feature, the metal is deposited from a chloride containing, fluoro containing or sulfur containing process liquid.

In accordance with another preferred feature of the invention, at least the surface of the cathode roller is made of aluminum, a valve metal, an alloy based on aluminum or a valve metal, a plastic which is electrically conductive, or an electrically conductive ceramic. The cathode roller, further, contains cooling medium ducts in the interior thereof. The cathode roller, preferably, rotates about a horizontal axis or about a vertical axis.

In accordance with a preferred feature of the invention, cooling ducts are coupled to a hollow shaft for the cathode roller, to conduct cooling liquid to the surface of the cathode roller.

DRAWINGS

DETAILED DESCRIPTION

Figure 1:
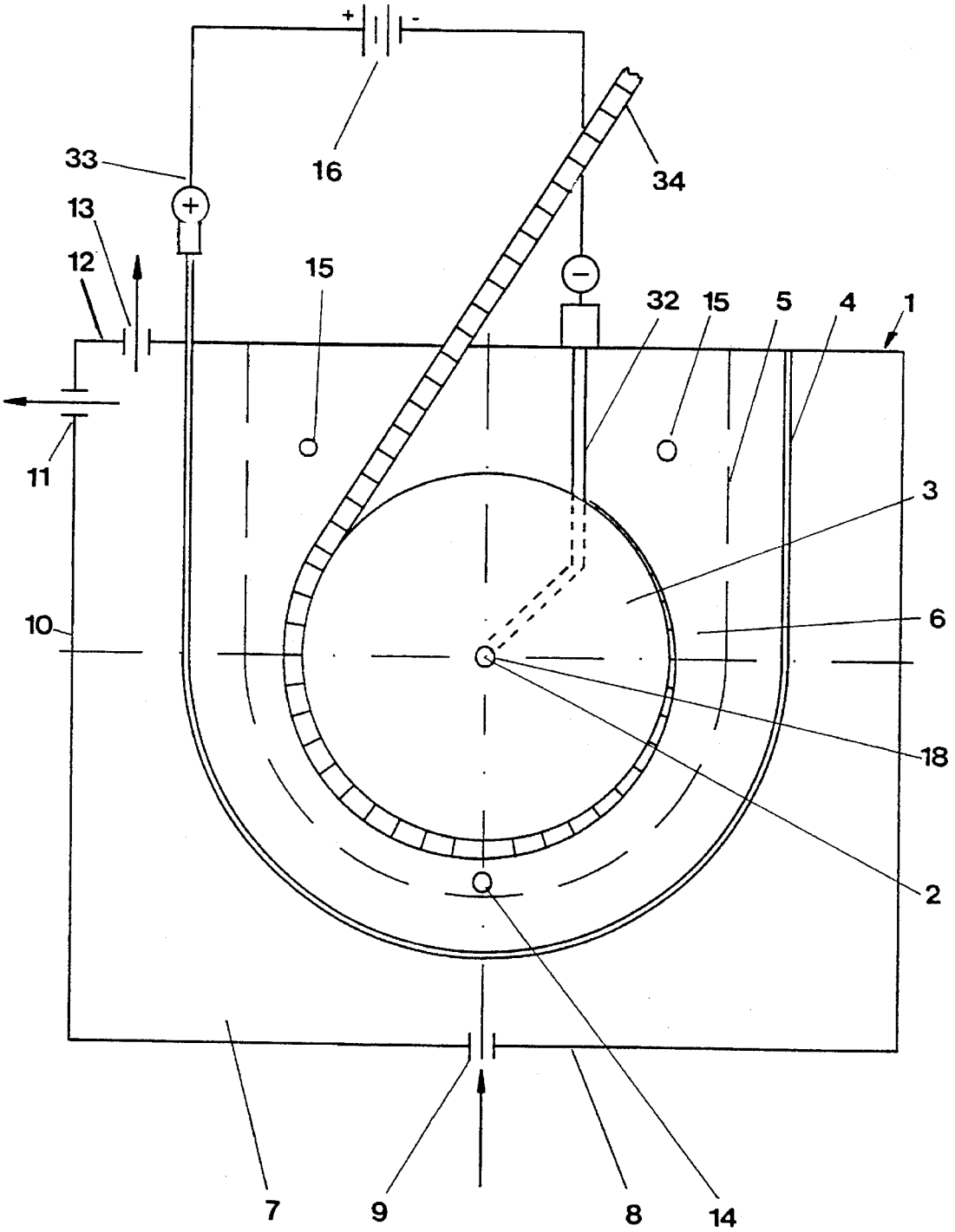
FIG. 1 is a highly schematic cross-sectional view through an apparatus carrying out the process having a cathode roller rotating about a horizontal axis.
Figure 2:
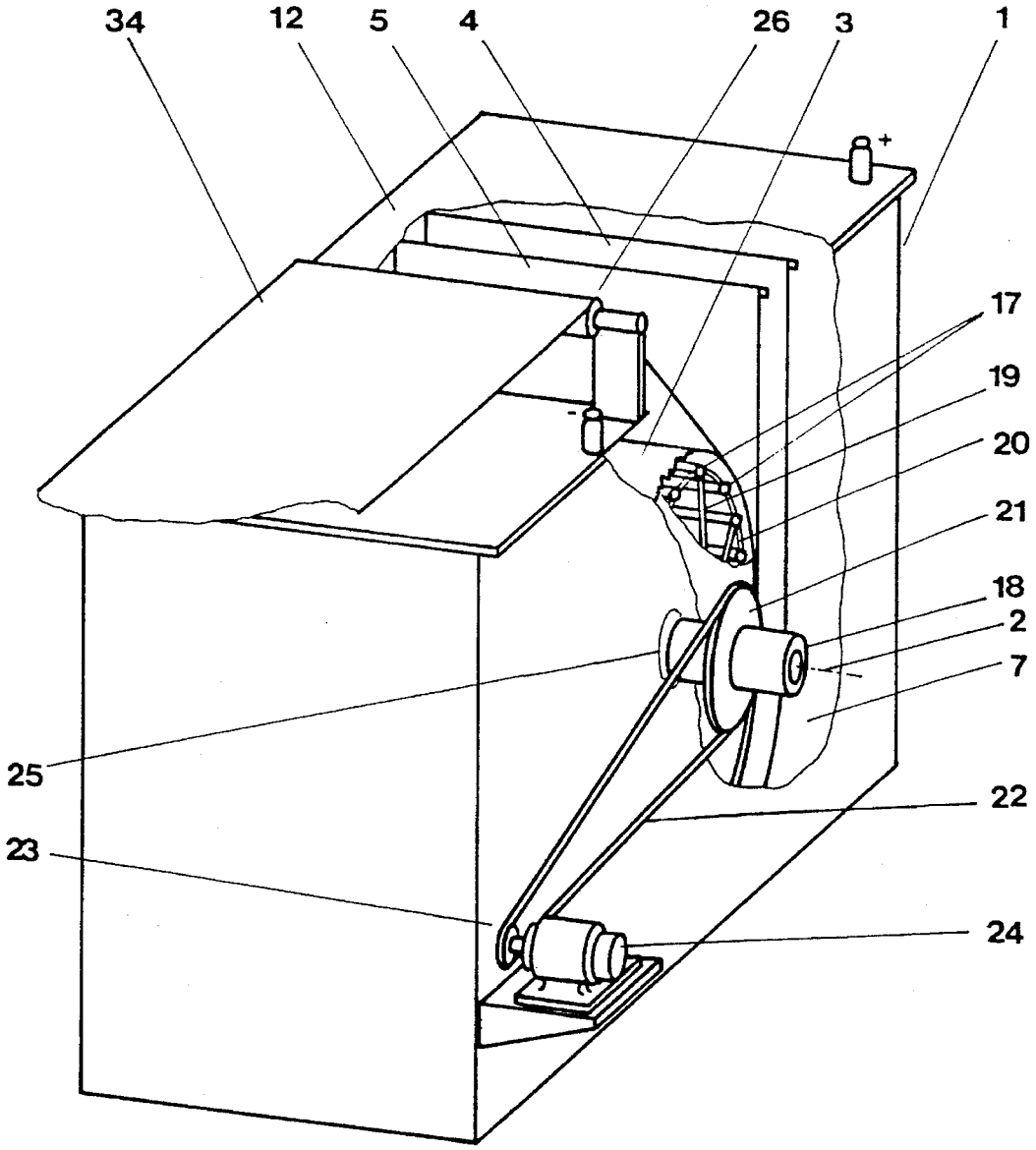
FIG. 2 is a perspective view of the apparatus, partly cut away to show interior portions.
Figure 3:
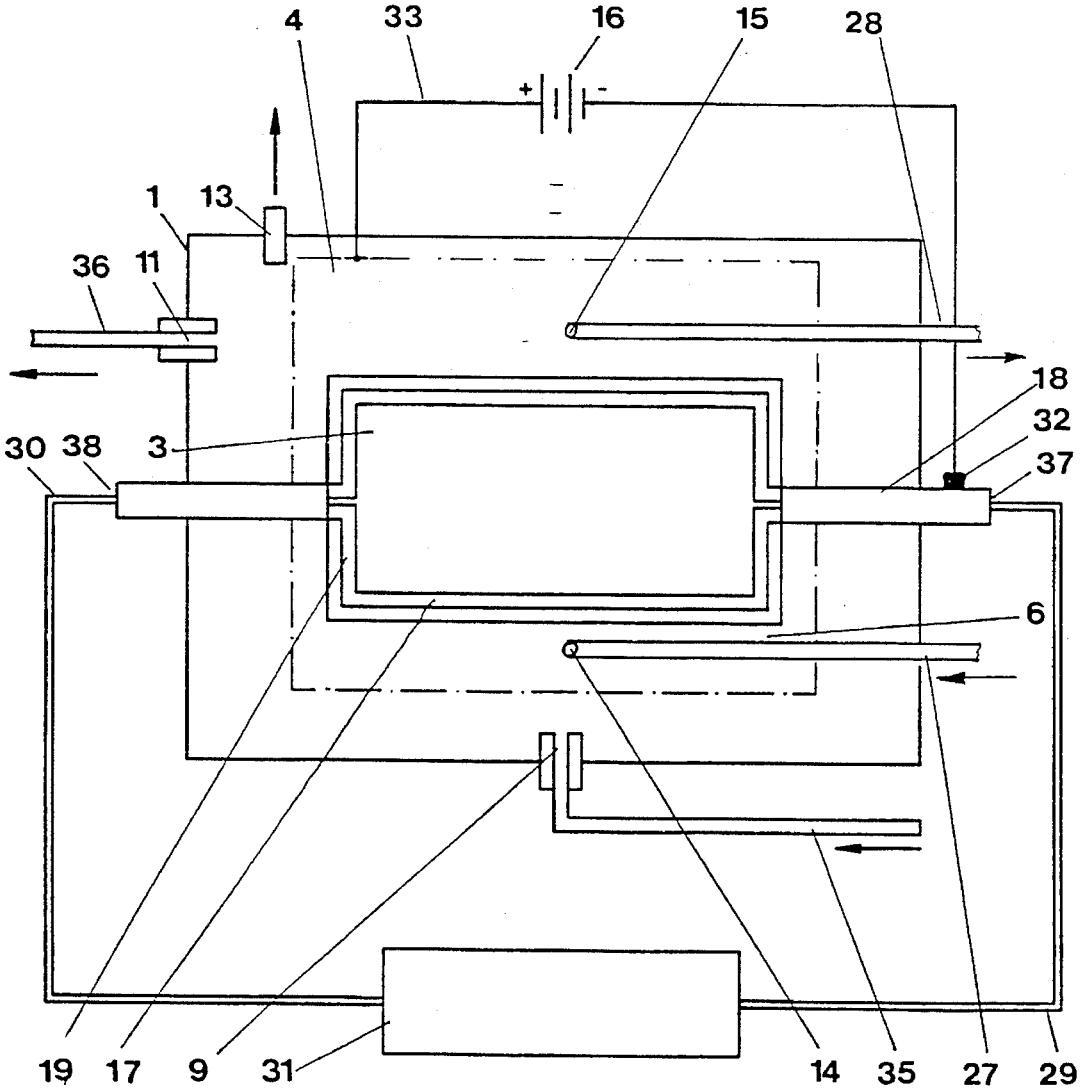
FIG. 3 is a schematic view of the apparatus of FIGS. 1 and 2, showing connections of supply and removal ducts.

Referring first to the embodiment of FIGS. 1–3:

A vessel or tank 1 receives the processing liquid. A cathode roller 3 is rotatable about a horizontal axis 2. An anode 4, at least in part surrounding the cathode roller 3, is likewise retained within the tank 1. The anode is formed as a part-segment of a hollow cylinder, spaced from the cathode roller or drum 3. A separating element 5 is located in the space between the anode 4 and the cathode roller 3. The separating element 5 is a sheet-like structure, for example formed as an ion exchange membrane, or a diaphragm, separating the space within the vessel 1 into a cathode electrolyte or catholyte space 6 and an anodic electrolyte or anolyte space 7. An inlet opening 9 for the anolyte is formed at the bottom 8 of the container or vessel 1; an exit opening 11 is formed at the upper portion of a side wall 10 of the tank 1 for the anolyte. Above the separating element 5, but below the cathode roller 3, a supply opening 14 is formed for the processing liquid forming the catholyte; a drain connection 15 for the catholyte is located above the cathode roller 3. One or more gas outlet openings 13 are formed in the cover portion 12 of the tank or vessel 1.

The cathode roller 3 is electrically coupled to a power supply source 16 by a hollow shaft 18, coaxial with the axis 2, which is made of conductive material or contains an electrical conductor, terminating in a rotary-stationary slider or slip contact 32 - only schematically shown in FIG. 1 - and coupled to the negative terminal of the power supply source 16. The anode 4 is coupled by connecting line 33 with the positive terminal of the power source 16. A metal foil, ribbon or tape can be removed from the cathode roller, as schematically shown at 34.

FIG. 2 illustrates, perspectively, a portion of the apparatus, with part of the cover and part of the roller broken away for better visibility of the components. The cathode roller 2 has interior cooling medium ducts formed, for example, by connecting lines 19 connecting the hollow shaft 18 to circumferentially located, axially extending cooling or heat control lines 17. Interconnecting ducts or lines 20 are provided, connected between the ducts 17. Supply and drainage, respectively, of liquid heat control medium is done by coupling the heat control medium to facing ends of the hollow shaft 18. The cathode roller 3 is rotated by a belt pulley 21, secured thereto, and driven from the pulley 23 of an electric motor 24 by a suitable belt drive 22. The anode 4, as well as the diaphragm or ion exchange membrane 5 can also be seen in FIG. 2.

The tank 1 is made of a plastic material which is resistant to chlorine solutions, for example made of polypropylene. Other materials may also be used, for example polyvinylchloride (PVC) or polytetrafluoroethylene. The surface of the cathode roller 3 which is exposed to the processing liquid is made of aluminum or an alloy based on aluminum; the surface of the cathode may, however, also be of titanium, a titanium based alloy, or an electrically conductive ceramic. The anode 4 preferably is made of titanium or a titanium based alloy and has an active surface. The separating membrane 5 preferably utilizes an ion exchange membrane.

The hollow shaft 18 is sealed in the tank by a rotating seal 25 and carried outside the tank; it is electrically insulated with respect to the housing 1. The outer end of the hollow shaft 18 carries the slip ring connection for further connection to the negative terminal of the current source.

The anolyte is supplied to the tank through the inlet opening 9 (FIG. 1) and washes over the surface anode 4, which is formed with openings. It is guided along the separating element 5 to the outlet openings 11. A typical anolyte is hydrochloric acid. Catholyte forming the processing fluid is supplied through the supply opening 14 (FIG. 3) and, after removal of metallic constituents, is drained over drain connections 15. Supply of processing liquid can be, in dependence on use, in form of continuous supply in a bypass process or in batches.

Operation: The anolyte is supplied as described above, and processing liquid in the form of catholyte, either continuously or in a batch, is supplied through the supply opening 14. The electric motor 24 (FIG. 2) is started, and current is applied to anode 4 and cathode roller 2 upon connection to the current supply source 16. Metal ions will then deposit on the cathode roller 3. In the example given, and assuming that the processing liquid is, for example zinc chloride, zinc ions will deposit on the cathode roller. The thickness of the layer of the metal deposited in form of a ribbon or a foil 34 increases in the direction of rotation of the roller. The cover portion 12 of the vessel 1 is formed with a slit, through which the continuous film formed by the ribbon 34 can be pulled off and over a support roller 26, and then, upon tension being applied to the film, can be rolled on a suitable reel by a ribbon or tape winding system. The thickness of the continuous film may vary between 0.1 to 2.5 mm; the film or tape 34 is drawn off from the cathode roller 3 in tangential direction, preferably under an angle in the range of approximately 45°. Separation from the roller 3 preferably occurs below the level of the liquid. By suitably arranging rotation, temperature of the cooling medium, and current supply, re-solution or dissolution of the deposited metal can be readily avoided.

EXAMPLE 1

A cathode roller having a circumference of approximately 35.6 cm is rotated at a speed of between ½ to 1 revolution per hour, resulting in a take-off speed of the tape, ribbon or foil 34 of between about 0.18 to 0.36 m per hour. Current density of applied electric energy is in the range of between 140 to 1200 $A/m^2$. The cathode roller 3 is cooled, and thus it is possible to operate with such a high current density, without incurring damage in the region of either the cathode roller 3 or the separating device 5. The processing liquid may also be heated, for example in the range of from approximately 40° to 80° C., without intermediate cooling. Chlorine, liberated during the electrolysis, is emitted through the gas exit opening 13, and removed, for example for further use or storage.

Other fluids may be used than those described; for example, the anolyte may be sulfuric acid or caustic soda; at the anode, then, oxygen would be generated.

FIG. 3 illustrates schematically the apparatus and the respective connections thereto. The power source 16 is connected over a line 33 with the anode 4 within the vessel 1 and over slider or slip ring terminal 32 and hollow shaft 18 with the cathode roller 3. The separating element 5 between the cathode roller 3 and anode 4 has been omitted for simplicity of illustration. The supply line 14 for the catholyte space 6 is coupled to a supply line 27 for the processing liquid; the drain 15 of the catholyte space 6 is connected to the removal line 28. The anolyte entrance opening 9 is connected to an anolyte supply line 35, and the anolyte exit or drain opening 11 with the drain line 36. Gas which is liberated upon deposition is led outwardly from the vessel or tank 1 over the gas outlet opening 13.

Cooling medium is applied through the end 38 of the hollow shaft 18; it is removed from the end 37, flows over connecting line 29 to a heat exchanger-cooler or radiator 31. Water is a suitable cooling medium. The cooling apparatus or heat exchanger 31 includes a standard heat exchanger system and a pump for circulating the cooling liquid. The liquid, cooled in the heat exchanger 31, is then supplied in a closed loop via connection 30 to the inlet end 38 of the hollow shaft 18 where, as previously described, it is supplied to the cooling lines 19, 17 within the cathode roller 3.

Figure 4:
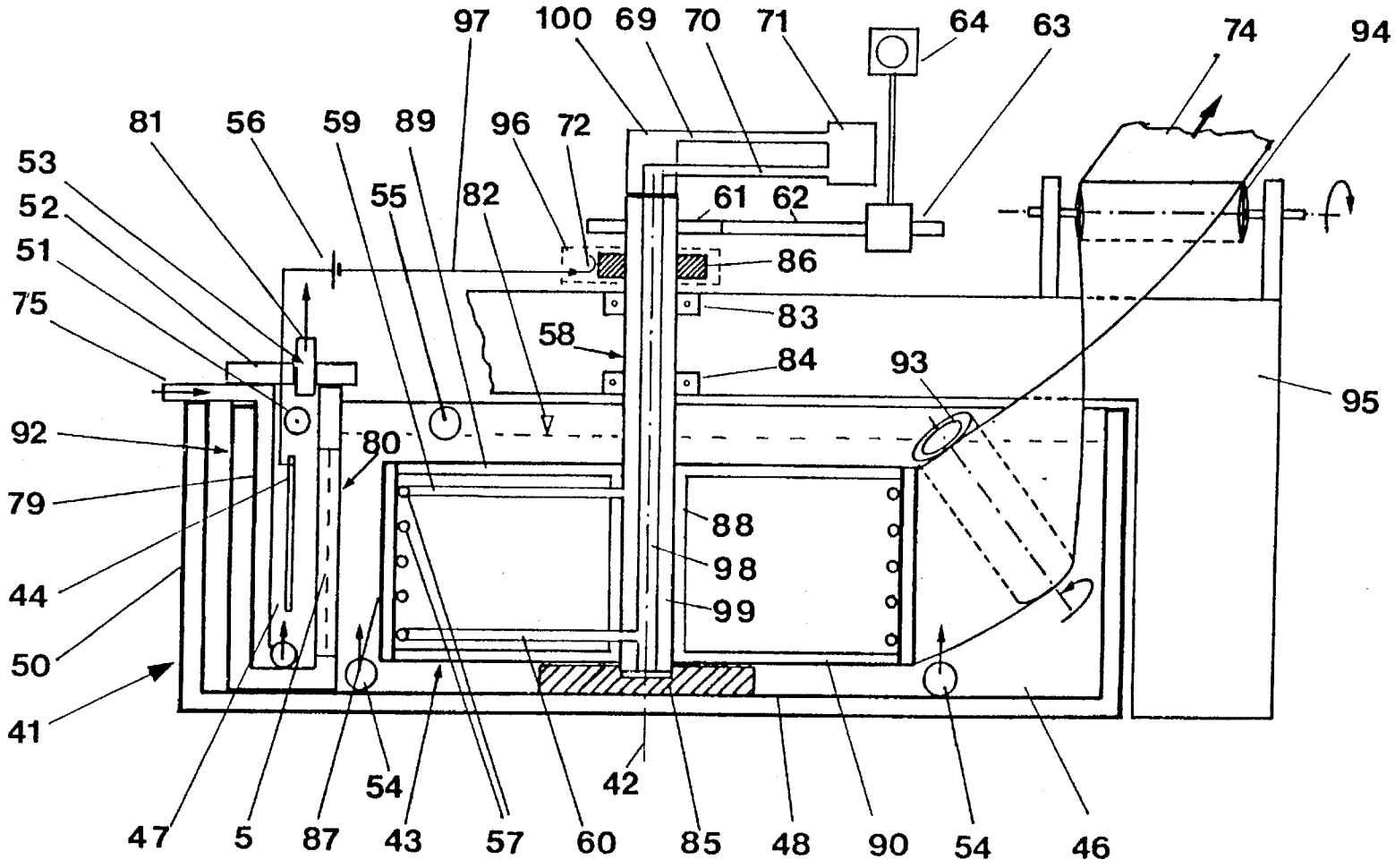
FIG. 4 is a schematic longitudinal cross-sectional view through the apparatus in which the cathode roller rotates about a vertical axis.
Figure 5:
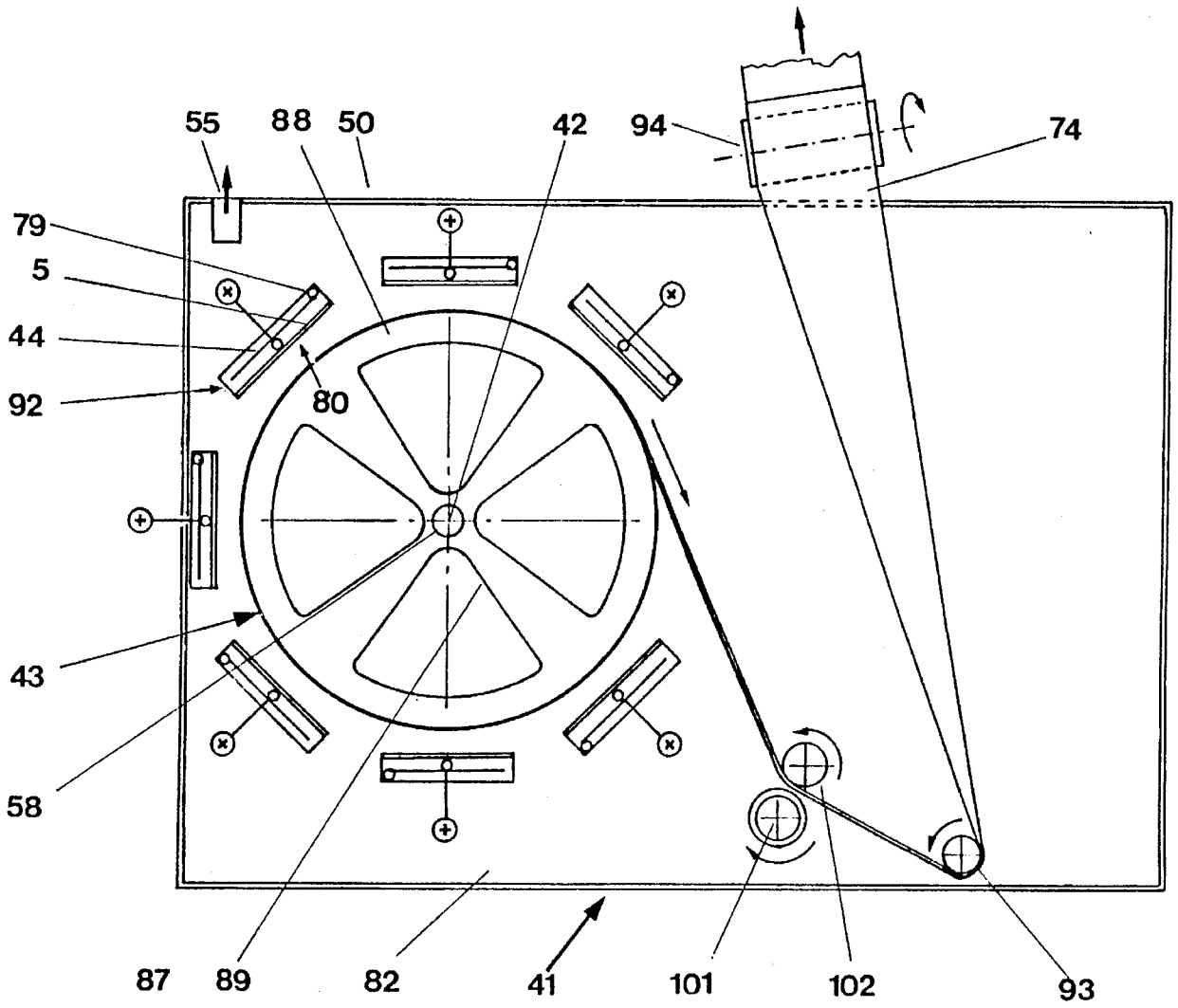
FIG. 5 is a schematic top view of the apparatus of FIG. 4, omitting portions not necessary for an understanding of the arrangement of the invention.

Referring now to FIGS. 4 and 5, which illustrate another embodiment, in which the cathode roller 43 is rotated about a vertical axis. The cathode roller 43 is retained within a trough-like or tank-like container 41, having side walls 50 which are higher than the cathode roller 43. This permits, by complete filling of the tank 41, to submerge the cathode roller 43 entirely within the processing fluid, and especially the circumferential surface 87 of the cathode roller 43 within the solution 82. The cathode roller 43 has a vertical axis 42, and, mechanically, a shaft 48 which is held in a pair of coaxial upper bearings 83, 84. A bearing 85 at the bottom 48 of the tank or vessel 41 forms an additional bearing to center the shaft 58.

A drive apparatus is coupled to the portion of the shaft 58 extending outside of the solution 82, formed by a belt pulley 61, a belt drive 62, a drive pulley 63, and a slip ring system 96, including a slip ring 86 and a slip ring contact or brush 72 to provide electrical connection to the roller or drum 43.

A ring-shaped supply pipe 54, with suitable openings therein, is located in the vicinity of the bottom 48 of the tank 41, located immediately adjacent the circumference of the cathode roller or drum 43, to supply the processing solution 82 containing the metallic ions.

The cathode roller 43 has a continuous circumferential surface 87 to receive deposition of metal. The surface 87 is held in a frame 88, coupled to the shaft 58 by suitable spokes 89, 90. The carrier frame 88 is stiff and rigid, and in a region beneath the surface 87 includes a heat exchanger 57 which, for example, is formed of tubes close to the inner portion of the circumferential surface 87, see FIG. 4. The heat exchanger 57 is coupled by connecting lines 59, 60 and via shaft 58 with a cooling apparatus 71, shown only schematically in FIG. 4. Drive of the drum or roller 43 is obtained by a schematically shown drive motor 64, a drive shaft, a belt pulley 63, the belt drive 62 and pulley 61, coupled to the shaft 58, so that, upon energizing the motor 64, the cathode roller or drum 43 will be rotated.

In accordance with a feature of the invention, the cathode roller 43 is surrounded by anode elements 92 (FIG. 5) positioned at least approximately concentrically to the axis 82. The anode elements 92 are spaced from each other to define a sufficiently large gap to permit the ribbon 74 drawn off the cathode drum or roller 43 to pass therethrough. The anode elements 92 include anodes 44, located each in a housing 79. The housings 79, each, are formed with an opening 80, directed towards the cathode roller or drum 43. The separating device 5 covers this opening; the separating device 5, preferably, is an ion exchange membrane, or a diaphragm. A seal is located between the separating element 5 and the frame-like outer portion of the housing 79 along the edge of the opening 80, so that the space within the housing 79 is closed to form a closed anolyte space, to separate the solution 82, which may be of a highly aggressive material from the anolyte within the housing 79. The solution 82, of course, will contain the metallic ions.

Anolyte is supplied over an anolyte supply line 75 to the housing 79, and removed from an exit opening 51; an anolyte overflow is provided.

The housings 79 for the anode 44 each are formed with a gas removal or gas outlet line 81 to remove gases arising at the anode. The respective lines 75, 51, 81 have been omitted from FIG. 5 for clarity of presentation.

The foil belt or ribbon 74 is removed or separated from the roller 43 within the solution 82, and carried outwardly in a space between the anode elements 92. It is guided via a deflection roller 93 to a 90° turning path and in that path leaves submersion from the solution 82. After the 90° turning path, the belt or ribbon 74 can be wound on a roller, or passed over a roller 94, having a horizontal axis of rotation. The position of the roller 94, the application of tension thereby, for example by partly looping the ribbon 74 thereabout, or by using an appropriate counter roller, can be controlled, in dependence on the speed of deposition. In accordance with a preferred feature of the invention, a fixed holder 95 is provided to hold the roller 94, as well as the bearings 83, 84 and the drive arrangement, as well as the contacting system 96 with the slip ring 72.

The contacting system 96 is coupled via connecting line 97 with the negative terminal of a power source 56; the anodes 44 are coupled to the positive terminal of the power source.

The temperature control lines 57 are connected over connection lines 59, 60 with a cooling supply and drain line 98, 99, respectively, coaxial with the cathode roller 43 and its shaft 58. All portions of the cathode roller 43, including the spokes 89, 90, and the portion of the shaft 58 which is within the solution 82, are formed with an electrically non-conductive or insulating surface, except for the outer circumferential surface 87 of the cathodic roller or drum 43. The non-conductive insulating surface is resistant to possible attack by the solution 82 of the electrolyte, that is, the catholyte, respectively.

The cathode roller 43 does not require special seals with respect to the outside, and thus the solution 82 can pass through its interior, so that cooling of the solution 82 within the portion passing through the interior of the roller 43 can also be obtained by the temperature control lines 57 forming heat exchanger portions. The cathode roller 43 is surrounded in its circumference by the anode elements 92, in which the anode elements cover a range of between about 180° to 270° of the circumference of the cathode roller 43. The ion exchange membranes or the respective diaphragm elements separate the electrolytic space into the anolyte spaces 47 and into a catholyte space 46 for the solution 82 containing the metallic ions. The supply line 54 of the catholyte is located immediately adjacent the lower edge of the surface 87 of the cathode roller 43 and close to the bottom 48 of the vessel 41. The outlet for the catholyte is located in one of the side walls 50 of the vessel or tank at the level of the upper edge of the circumferential surface 87 of the roller or drum 43. For some arrangements it may be suitable to locate flow distributions vanes or guides, to ensure uniform distribution of the catholyte over the entire surface 87 of the roller 43. Anolyte for the anode elements 92 is supplied and removed by individual supply lines from above.

The surface 87 of the cathode roller or drum 43 is made of aluminum or titanium, or an aluminum based alloy or a titanium based alloy. The interior of the surface 87 is of plastic which is resistant to the electrolyte, that is, the catholyte, respectively. Electric connections may be conducted within the spokes 89, 90, sealingly surrounded by plastic material. The drive shaft 58 is also coated or sheathed with plastic, at least in the portion which is within the electrolyte, the plastic being resistant to the electrolyte or catholyte, respectively. The interior of the plastic sheath, tube or the like, for example a pipe or tubular plastic cover, retains the cathode current supply lines as well as cooling medium connections and pipes. The cathode current supply may be formed by the shaft 58, which, for example, is made of metal. A separate current supply conductor may also be used, extending parallel to the shaft 58.

Cooling substance is supplied from a cooling heat exchanger 71 over connection lines 70 and the inner hollow cylinder of a coupling 100 formed with suitable seals, to supply cooling medium to the interior of the shaft 58, or between a plastic tube surrounding the shaft, to form a cooling supply line 98. Cooling medium is drained over a cooling medium drain line 99, positioned coaxially with respect to line 98, the outer hollow cylinder of the coupling 100 and connection line 69 to the cooling-type heat exchanger 71.

FIG. 5 illustrates schematically, and omitting features not necessary for an understanding of the figure, a cathode roller 43 fitted into a tank-shaped or trough-shaped container 41, the cathode roller 43 rotating about vertical axis 42 by shaft 58. The scale of the drawing of FIG. 5 differs from that of FIG. 4. Cathode 43 also illustrates the frame structure 88 and spokes 89; the cooling supply lines and the heat exchanger have been omitted. The frame structure 88 of the cathode roller 43 also shows that the outer surface 87 is applied over the otherwise electrically insulating surface which surrounds the frame 88. The deposited metal is removed as the ribbon 74 and separated from the cathode roller 43 while still within the solution 82. It is pulled off in at least approximately tangential direction, guided over deflection roller 93, twisted 90° over the twist path for guidance over a pull-off roller 94, and/or winding up on the pull-off roller 94. Further guide rollers 101, 102, shown in FIG. 5, may be provided for better stabilization and guidance of the pulled off foil, ribbon or tape. At least one of the rollers 93, 94 and, if desired, rollers 101, 102 as well, may be driven.

The anode elements 92, preferably, surround the cathode roller 43 in a circumferential range of about 270°, although it may be more, or less. The anode elements 92 have essentially flat anodes 44, the separating element 5 separating anolyte from catholyte in the vessel 41. Customarily, anode housings 78 are closed off at the top, containing, however, a gas removal duct for gases which will develop at the anode.

The current supplies, the anolyte supply and drain lines 75, 51 are shown only schematically in FIG. 4. The drain 55 for the solution 82, likewise, only shown in FIG. 4 is in the upper portion of the tank 41.

By suitable selection of speed, temperature of the cooling medium, current density at the cathode and the like, it is possible to entirely eliminate the danger of dissolution of already deposited metal within the catholyte.

EXAMPLE 2

With Reference to the Embodiment of FIGS. 4 and 5

A cathode roller 43, having a circumference of about 30 cm, is rotated at a speed of one-half to two revolutions per hour. The surface 87 of the cathode roller is made of aluminum. To obtain a ribbon 74 of between 0.2 to 0.4 mm, a removal speed of from between 0.3 to 0.6 meters per hour is suitable; cathodic current density is in the region of from 300 to 6000 $A/m^2$; optimum deposition temperatures were obtained in a cathodic current density of about 4000 $A/m^2$. The solution 82 was a zinc chloride solution. Chlorine generated during deposition was removed from the gas removal ducts and openings from the vessel and can be collected for re-use.

Cathode rollers 43 with a larger diameter of up to about 1 meter can be used.

Other suitable processing liquids having metal ions as a catholyte may be used, for example processing liquid containing fluorides or sulfates.

In a preferred form of the invention, the respective shafts for the cathode rollers or drums 3, 43 are hollow, so that they can function at the same time as cooling supply or drain connections. One end of the hollow shaft forms the supply entrance, and the opposite end the drain exit. This is a particularly simple arrangement, easy to carry out, and requiring practically no maintenance.

A vertically extending shaft likewise is suitable to form part of the cooling circuit, for connection of cooling medium to the inner surface of the hollow cathode roller or drum. Preferably, two coaxial hollow cylinders are used, in which the inner hollow cylinder is coupled to a cooling medium supply line, and the outer hollow cylinder to a cooling medium drain line, the cooling medium then being supplied between the respective lines to the inner surface of the hollow cathode roller or drum. The lower end of the hollow shaft, preferably, is supported on a suitable bearing.

The cathode rollers, in accordance with a feature of the invention, can be easily exchanged. They can be lifted off their bearings by merely raising them out of the bearings. As well known, the bearings can be formed as connected half-shells, so that removal of the cathode roller is simple. The drive and contacting elements for the cathode roller likewise are easily accessible outside of the electrolyte tank and, if the shaft is vertical, can be located at the upper end of the shaft, reliably cleared from the solution containing metallic ions, without requiring complicated seals.

Separating the anolyte and the catholyte by a diaphragm or an ion exchange membrane is particularly suitable when sulfur containing solutions are used; diaphragms are particularly suitable for chloride containing solutions. Gases which are liberated at the anode in secondary reactions, such as chlorine when the solution contains chlorides, or oxygen when the solution contains sulfates, can be removed for re-use, storage or re-sale. Separating the gases at the anode also improves safety with respect to explosions due to the presence of detonating gas, for example oxygen hydrogen gases or chlorine detonating gases, which might arise in secondary reactions with hydrogen derived from the cathode roller. Separating the anolyte space from the catholyte space further prevents contamination of the processing liquids at the anode, thus not changing the quality or constituents of the anolyte, even if the processing liquids are contaminated or aggressive and have the tendency to attack other substances. In a particularly preferred feature of the invention, which permits easy maintenance and, if necessary, replacement of components or elements, the anode segments are located in closed anode boxes - see FIG. 4 - which also retain the sealing diaphragms or ion exchange membranes 5, to permit placement of plate-like or surface anodes which, as separate elements, surround the cathode roller.

The apparatus is, in accordance with a preferred method, used with a processing liquid of, for example, zinc chloride, with a cathode roller surface formed of aluminum, to obtain a zinc ribbon in continuous production. Speed and cooling medium temperature, as well as current density, can be so adjusted, as determined by a few experiments, that a maximum length of ribbon is obtained at a suitable speed which prevents dissolution of the zinc ribbon within the electrolyte as it is removed from the cathode drum. The placement of the diaphragm or the ion exchange membrane, with respect to the ribbon or tape being removed from the roller, is such that dissolution of the zinc of the tape is effectively prevented.

The system permits essentially automatic operation, and removal of metals from an ion containing processing liquid, as well as deposition or metal recovery of highly aggressive processing liquids by separating the electrolyte space into an anolyte and a catholyte space, the catholyte space receiving the processing liquid. Hydrochloric acid is suitable as an anolyte. Use of higher speeds of the cathode rollers effectively prevents re-solution or dissolution of the tape, when still in the catholyte bath.

The cooling effect of the cooling medium in the heat exchange cooling loop should, preferably, be such that the temperature at the surface of the respective cathode roller or drum 3, 43 is in the range of about 20° to 80° C., the lower temperature being determined by the cooling capacity and space available for passage of cooling medium; exceeding the upper temperature causes damage of the plastic material.

Various changes and modifications may be made, and any features described therein in connection with any one of the embodiments may be used with any of the others, within the scope of the inventive concept.

EXAMPLE 3

With Reference to the Embodiment of FIGS. 4 and 5

A cathode roller 43, having a circumference of about 30 cm, is rotated at a speed of one-half to two revolutions per hour. The surface 87 of the cathode roller is made of aluminium. To obtain a ribbon 74 of between 0,2 to 0,4 mm, a removal speed of from between o.3 to 0.6 meters per hour is suitable; cathodic current density is in the region of from 300 to 6000 A/m$^2$; optimum deposition temperatures were obtained in a cathodic current density of about 3000 A/m$^2$. The solution 82 was a zinc sulfate solution containing fluoride. Oxygen generated during deposition was removed from the gas removal ducts and openings from the vessel

We claim:

1. An apparatus for continuously obtaining a metal in form of a ribbon, tape or foil by recovery of the metal from a solution containing metal ions by a method wherein metal ions are continuously deposited on a cathode to form a metal layer which is removed from the cathode as a ribbon, tape or foil;

said apparatus comprising a vessel or tank (1, 41) having a catholytic space formed therein to contain the solution containing metal ions;

a rotatable cathode roller or drum (3, 43) having a surface on which the metal ions are to be deposited, rotatable about an axis (2, 42) of rotation, located in the catholytic space (6) in said vessel or tank; and an anode (4, 44) located in said vessel or tank, spaced from said cathode roller or drum and, at least in part, surrounding said cathode roller or drum;

wherein the surface of the cathode roller or drum (3, 43) comprises at least one of aluminum, a valve metal, an aluminum base alloy, a valve metal base alloy, an electrically conductive plastic, or an electrically conductive ceramic;

said apparatus further comprising a separating element (5) located between the anode (4, 44) and the cathode roller or drum (3, 43) to seal the anode (4, 44) from the catholytic space (6) and form an anolyte space (7); a liquid inlet opening (9) in communication with the anolyte space (7) and through which an anolyte can be introduced into anolyte space (7); and a cooling medium conduction means (17, 19, 20; 57, 59, 60) located interiorly of said cathode roller or drum for cooling said cathode roller or drum; and a hollow shaft supporting said cathode roller or drum, and concentric with said axis of rotation (2, 42); and cooling medium supply and drain lines (17, 19, 20) connected to opposite ends of the hollow shaft to form, respectively, a cooling medium inlet and cooling medium outlet from the hollow shaft;

wherein said hollow shaft (58) has two concentric cooling medium lines (98, 99), one, respectively, forming a cooling medium supply line and the other (99) forming a cooling medium drain line.

2. The apparatus of claim 1, wherein the axis of rotation (2) about which the cathode roller or drum (3) rotates is horizontal.

3. The apparatus of claim 1, wherein the axis of rotation (42), about which the cathode roller or drum (43) is rotatable, extends in a vertical direction.

4. The apparatus of claim 1, wherein said anode means (4, 44) comprises at least two segments facing the outer surface of the cathode roller or drum.

5. The apparatus of claim 4, wherein at least one of the segments is formed with openings therein.

6. The apparatus of claim 1, wherein said separating element comprises a diaphragm.

7. The apparatus of claim 1, wherein said separating element comprises an ion exchange membrane.

8. The apparatus of claim 1, wherein said separating element at least partially shields the anode (4, 44) from the cathode roller or drum (3, 43).

9. The apparatus of claim 1 further including a housing (79), the anode (44) being located within the housing, said housing being formed with an opening (80) facing the cathode roller or drum (43);

and wherein said separating element (5) closes off the opening (80) formed in the housing.

10. The apparatus of claim 1, further including a gas outlet opening (53) formed in the housing (79), and a gas removal duct (81) coupled to said gas outlet opening (53), said separating element (5) being sealed against an opening in the housing (79).

11. The apparatus of claim 1, wherein said vessel or tank (1 41) is formed with the anolyte inlet opening (9) close to the bottom (8, 48) of the vessel or tank (1 41);

and further comprises an anolyte drain or outlet (11) formed in a side wall (10, 50) of the vessel or tank.

12. The apparatus of claim 1, further including a catholyte inlet (14, 54) located between the cathode roller or drum (3, 43) and the separating element (5), in communication with the catholyte space (6); and a catholyte outlet (15, 55) positioned above an upper level of the cathode roller or drum (3, 43) for removal or draining of catholyte contained in the catholyte space (6).

13. The apparatus of claim 1, further including a cover (12, 52) covering the vessel or tank (1, 41);

and a gas outlet opening (13,53) formed in said cover.

14. The apparatus of claim 1, wherein said ribbon or tape or foil is a zinc ribbon, tape or foil, and said solution containing metal ions comprises a solution including zinc chloride.

* * * * *